US006820555B2

(12) United States Patent
Grasselli

(10) Patent No.: US 6,820,555 B2
(45) Date of Patent: Nov. 23, 2004

(54) PRINTING PROCESS AND PRINTING APPARATUS

(75) Inventor: Enrico Grasselli, Tomo (IT)

(73) Assignee: Lechler S.p.A., Como (IT)

( * ) Notice: Subject to any disclaimer, the term of this patent is extended or adjusted under 35 U.S.C. 154(b) by 75 days.

(21) Appl. No.: 10/169,977

(22) PCT Filed: Dec. 13, 2000

(86) PCT No.: PCT/IT00/00515

§ 371 (c)(1),
(2), (4) Date: Jul. 12, 2002

(87) PCT Pub. No.: WO02/49857

PCT Pub. Date: Jun. 27, 2002

(65) Prior Publication Data

US 2003/0091743 A1 May 15, 2003

(51) Int. Cl.[7] ..... B41M 1/12; B41F 16/00; B41F 23/04

(52) U.S. Cl. ..... 101/487; 101/492; 101/129

(58) Field of Search ..... 101/114, 129, 101/487, 488, 492, 491; 347/103; 399/302

(56) References Cited

U.S. PATENT DOCUMENTS 5,017,418 A * 5/1991 Groshens ..... 428/196
5,343,802 A * 9/1994 Shimada ..... 101/35
5,830,263 A 11/1998 Hale et al.
6,332,067 B1 * 12/2001 Domoto ..... 399/307
6,354,700 B1 * 3/2002 Roth ..... 347/103
6,386,697 B1 * 5/2002 Yamamoto et al. ..... 347/103
6,561,645 B2 * 5/2003 Miyamoto ..... 347/106
2003/0067529 A1 * 4/2003 May et al. ..... 347/103

FOREIGN PATENT DOCUMENTS

| | | | |
|---|---|---|---|
| CH | 319 259 A | | 2/1957 |
| EP | 0 649 753 A | | 4/1995 |
| GB | 1 593 501 | * | 7/1981 |
| WO | 91/06433 A | | 5/1991 |
| WO | 95/13923 A | | 5/1995 |
| WO | 00/59733 A | | 10/2000 |

* cited by examiner

*Primary Examiner*—Leslie J. Evanisko
(74) *Attorney, Agent, or Firm*—Nixon & Vanderhye P.C.

(57) ABSTRACT

A process and a plant for applying of one or more compounds, such as inks or coatings, to a substrate. In each station of the plant at least one compound is applied by a process that requires applying an essentially liquid mixture containing the compound to be applied to a transfer medium, heating the tranfer medium to obtain coagulation of the portion of the mixture which is in contact with the transfer medium, and placing the transfer placed in contact with the substrate so that the coagulated portion of the mixture is applied to the substrate.

25 Claims, 6 Drawing Sheets

PRINTING PROCESS AND PRINTING APPARATUS

TECHNICAL FIELD OF THE INVENTION

The present invention generally relates to a process and a plant to apply one or more compounds to a substrate and, in particular, a process and plant intended to be used for printing with one or more colours on substrates of different kinds.

BACKGROUND OF THE INVENTION

Currently various techniques are known for generally applying one or more compounds to a substrate or, in particular, printing one or more colours on substrates of different kinds, such as paper, fabrics, synthetic films or the like. In general, printing can be effected by directly applying impressions of various colours to the substrate intended to receive these or, alternatively, using "transfer" techniques, according to which the impressions of each of the different colours are first applied to a transfer medium which is then placed in contact with the substrate of destination.

Irrespective of the possible advantages or disadvantages of each printing technique, the choice of one of these two techniques is also determined by the type of material which forms the substrate to be printed and/or the type of material, such as ink or the like, to be applied to the substrate.

A specific example of the application of the present invention is printing on fabrics or the like. Reference to this particular field of application must be considered merely as an unlimited example of the present invention.

Traditionally, printing on fabrics is effected using vinyl-chloride resin based inks, such as polyvinylchloride (PVC), which are applied directly to the fabric using screen printing techniques. These methods generally allow a high level of productivity and satisfactory quality of print to be obtained.

Nonetheless, the presence of vinyl-chloride resins in these type of inks now makes this technique unacceptable from the viewpoint of safeguarding the environment. In fact, these resins may cause dioxin to form during the step to dispose of the fabric as refuse. Moreover, printing machinery using these types of inks must be cleaned using solvents that may be harmful to the environment. From the viewpoint of national and international regulations, increasingly sensitive to problems of safeguarding the environment, there is therefore a tendency to gradually limit the use of these inks through time, until products manufactured in this way are totally eliminated from the market.

Direct application on the substrate of compounds without vinyl-chloride resins, such as inks generally composed of volatile solvents, for instance water-based inks, nonetheless causes various problems.

Firstly, productivity is drastically reduced, especially if several colours or several compounds are to be applied to the substrate. In fact, to obtain an acceptable quality of print, the solvent of the ink of a specific colour (or a specific compound) must be removed before the subsequent colour (or compound) is applied.

In the case of prints with different colours, this is implemented by setting up a drying station immediately downstream from the printing station of each colour and keeping the substrate to be printed at a high temperature for a preset time in the drying station before sending it to the subsequent printing station, where another colour is applied.

Moreover, the substrate subjected to drying must in any case be left to cool before being sent to the subsequent printing station, since if the substrate were still hot this would cause coagulation of the ink present on screen of the next screen printing station.

If the substrate is formed of fabrics or the like, direct application of water-based inks using the screen printing technique has to date proved to be somewhat unsuitable for printing on dark coloured fabrics due to the poor covering effect that these inks can guarantee when applied directly to fabrics in a liquid state.

In general, the object of the present invention is to provide a process and a plant that allow one or more compounds to be applied to a substrate overcoming the problems of the prior art.

Another object of the present invention is to provide a plant of the aforesaid type particularly small in size and which consumes less power than plants of the known kind.

More specifically, another object of the present invention is to provide a process and plant that allow the application to a substrate of compounds with no vinyl-chloride resins whatsoever.

Yet another object of the present invention is to provide a process and plant that allow improvement of the productivity of the techniques for application to a substrate of compounds with volatile solvents.

Another more specific object of the present invention is to provide a process and a plant that allow particularly efficient application of compounds comprising volatile solvents to specific types of substrate, such as fabrics or the like.

DISCLOSURE OF THE INVENTION

These objects are achieved according to the present invention thanks to a process for the application of one or more compounds on a substrate, the process comprising the steps of:

a) applying a preset amount of a mixture to a transfer medium, the mixture comprising one or more compounds in the form of a solution, emulsion or suspension and being essentially in a liquid state;

b) heating the transfer medium to a preset temperature to obtain at least a partial coagulation of the portion of the mixture in contact with the transfer medium, the other portion of mixture remaining in its essentially liquid state; and c) placing the transfer medium in contact with the substrate by exerting a given pressure so that the coagulated portion of the mixture is placed on the substrate.

In this way it is possible to obtain efficient covering of the substrate, because a part of the mixture that is transferred to the substrate has already coagulated or, in other words, has already been deprived of part of the solvent at the time of application.

By obtaining a surface layer that has already coagulated specifically allows the immediate application of a subsequent compound, for example the portion of an impression implemented with a product having different composition or colour specifications, without having to perform any intermediate drying steps of the previous compound and without the risk of unwanted mixing of compounds, such as smudging of colours if the compounds are inks, around the edges of adjacent areas.

According to another aspect of the invention, the process also comprises cooling of the transfer medium before application of another preset amount of the mixture to the same support. If a mixture comprises a volatile solvent, by cooling the transfer medium this prevents the next compound from being coagulated by this still hot support at the time it is applied to this transfer medium. This is particularly advantageous if the screen-printing technique is used to deposit the compound on the transfer medium, as this prevents the compound from coagulating on the printing screen and clogging the holes through which the compound passes.

In the specific case in which the substrate is formed of a fabric or the like, during transfer of the compound from the support to the fabric below, the part of the mixture that is still liquid is free to penetrate deep into the fabric, thus consolidating adhesion of the compound to the fabric.

The invention also concerns a plant for applying one or more compounds to a substrate, of the type comprising one or more stations, each of which provided with means to apply an essentially liquid mixture comprising at least one of the compounds to a transfer medium in order to subsequently obtain the application of the compound on the substrate, characterised in that each of the stations comprises means for adjusting the temperature of the relevant transfer medium and means for adjusting the contact pressure between the relevant transfer medium and the substrate on which each compound is to be applied.

In the specific case of a plant for the application of compounds based on volatile solvents, a plant with a particularly small size is thus obtained as it is no longer necessary to provide a drying station for the mixture applied to the substrate below each application station.

In the specific case of plants for printing on fabric substrates, taking into account that plants of the known type can have up to ten printing stations (one for each colour) it is easy to understand the advantages of a plant implemented according to the present invention.

According to a possible embodiment of the invention, the transfer medium consists of a closed belt that is made to rotate between at least two cylinders.

In this case at least a first cylinder is provided to heat the transfer medium in a controlled manner and to exert, also in a controlled manner, the contact pressure between the transfer medium and the substrate. A second cylinder cools the transfer medium in a controlled manner and the mixture is applied to the transfer medium at the level of this second cylinder.

According to another possible embodiment, the transfer medium is formed of a closed belt that rotates between at least three cylinders.

Similarly to the previous possible embodiment, the first cylinder is designed to heat the transfer medium in a controlled manner and exert, in a controlled manner, contact pressure between the transfer medium and the substrate. A second cylinder is used to cool the transfer medium in a controlled manner while, differently to the previous possible embodiment, at least a third cylinder is provided, at the level of which the mixture is placed on the transfer medium.

In both cases, the mixture can be placed for example on the transfer medium by means of a screen printing device.

BRIEF DESCRIPTION OF THE DRAWINGS

The invention will be described below with reference to the annexed schematic drawings, in which.

MODES FOR CARRYING OUT THE INVENTION

A possible embodiment of the present invention is illustrated below, merely as an unlimited example, with reference to a plant for printing with one or more colours on a textile substrate, in which inks based on volatile solvents are preferably used, such as water-based inks. It is understood that the same principles on which the invention is based may be applied not only to printing systems, but also to systems designed for the application of coating materials or coverings in general on substrates of various types.

Figure 1:
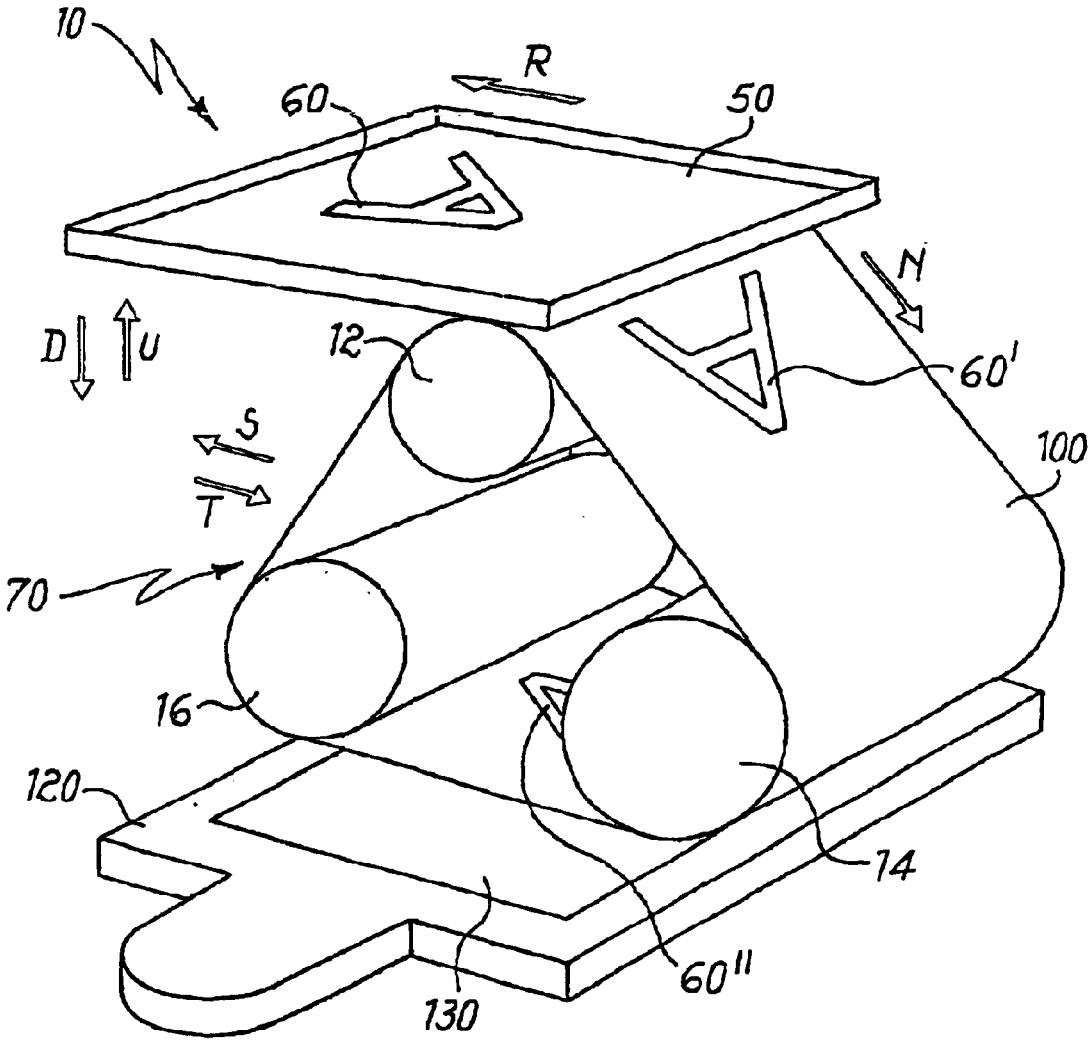
FIG. 1 is a perspective view of a possible embodiment of a printing station in a plant according to the present invention.

The printing station 10 illustrated in FIG. 1 comprises a transfer unit 70 formed essentially of a transfer medium or belt 100 and three cylinders 12, 14 and 16 around which the belt itself is made to rotate. Below the cylinders 14 and 16 there is a substrate 130 on which an impression 60 with a pre-established layout must be reproduced, for example such as the letter "A" indicated in FIG. 1. The substrate 130 can consist of a pre-cut member arranged for example on a supporting table 120 or directly on a continuous conveyor belt, or it may consist of a continuous member.

The cylinders 12, 14 and 16 of the transfer unit 70 may have, for example, the same diameter and be made to rotate at the same speed. Alternatively, it is possible to use cylinders with different diameters from one another, especially according to the various requirements for heating and cooling the transfer medium 100, choosing the relevant rotation speeds appropriately.

In the case in which a device for screen printing is used, the printing station 10 comprises a printing screen 50 over which a doctor blade (not shown) moves, to transfer the ink according to well-known modes in this technical field.

During operation, which shall be explained in more detail below, the cylinders are made to rotate so that the transfer medium or belt 100 moves in the direction indicated by arrow N and the transfer unit 70 moves cyclically in horizontal direction (arrows S and T) and vertical direction (arrows U and D) to alternatively place the belt 100 in contact with the screen 50 and fabric 130.

In a first step of the process, the ink on the printing screen 50 is applied to the transfer medium 100 by the doctor blade (not shown) that moves in the direction indicated by arrow R, while the transfer unit 70, with the belt 100 in contact with the screen 50, moves in the direction indicated by arrow S. In this case, the linear speed of the belt 100 in the direction N is equal to the linear speed of the doctor blade in the direction R and the linear speed of the transfer unit 70 in the direction S.

The ink on the printing screen is thus transferred on the transfer medium 100 according to the pre-established layout, thus making an impression 60'. The impression 60' consists of a product that is preferably in an essentially liquid state at room temperature.

The belt 100 on which the ink has been applied according to the layout 60' is thus fed towards the cylinder 14 while the transfer unit 70 is lowered in the direction of arrow D until it comes into contact with the substrate 130 on which the impression is to be transferred.

In this phase, the impression 60' on the belt 100 passes around the cylinder 14, consisting specifically of a heated cylinder, of which the heating temperature and contact pressure exerted by the cylinder 14 on the substrate below are preferably controlled. The pressure and temperature are regulated according to the type of ink to be transferred to the substrate or, more generally, the type of covering substance to be applied to the substrate.

Figure 2:
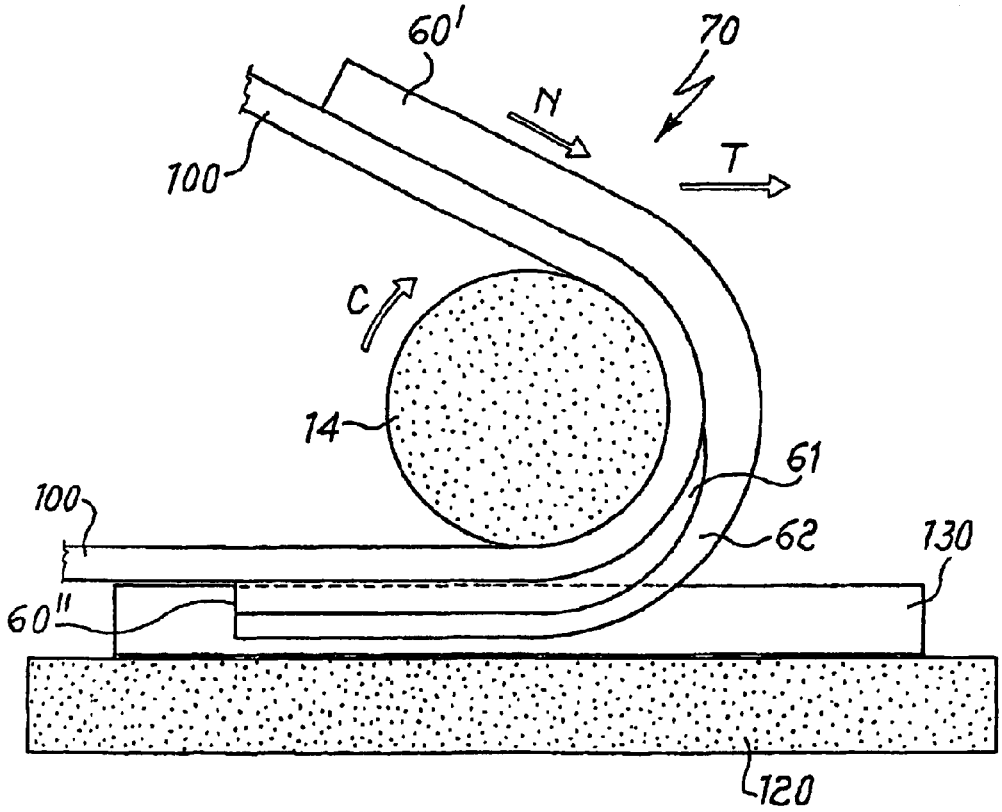
FIG. 2 is an elevation view of a detail of the printing station in FIG. 1 during a step of the process according to the present invention.

As better highlighted in the detailed view in FIG. 2, when the belt 100 with the impression 60' passes around the cylinder 14 this causes coagulation of the portion of ink 61 that is in direct contact with the belt 100 before this portion 61 passes through the contact zone between belt 100 and substrate 130, while the remaining portion 62 of the ink that forms the original impression 60' remains in an essentially liquid state.

In the specific case of printing on a textile substrate 130, or one in a material with permeable characteristics in relation to the liquid ink used, an impression 60" is thus transferred which already comprises a coagulated surface layer 61 placed over a layer 62 which is essentially liquid, while the latter penetrates deep into the fabric consolidating adherence of the impression to the fabric. It is therefore possible to subject the substrate 130 to a further step of transferring ink immediately without intermediate drying steps and without smudging occurring between adjacent zones of different colours.

The formulations of inks that can be used for printing according to the process of the present invention are somewhat common and can also be found on the market. In any case it is advisable to underline that the formulation of an ink for a specific application is the result of a compromise between various characteristics, often contrasting, such as printability, cover, resistance, cost and toxicity.

In general, formulations of ink suitable for use in the present invention are formed of water-based emulsions with dry product ranging between 20% and 70% of the total weight.

More specifically, the formulations comprise resin-based binders chosen from acrylic resins, vinyl resins, acrylic styrol resins, butadiene resins, vinylacrylate copolymer resins and polyurethane resins in an amount (dry) between 10% and 50% in weight. Suitable resins available on the market comprise for example ACRILEM ES8 (ICAP-SIRA) and PRIMAL E 358 (ROHM & HAAS).

Other components of typical formulations of inks comprise mineral charges ranging from 1 and 50% in weight (for example MICRO TALCO AT1 marketed by URAI; PASILEX P 820 marketed by EIGENMANN), organic and inorganic pigments ranging from 1% to 30% in weight (for example TIOXIDE R 900 marketed by GARZANTI; NOVOPERM ROSSO F3RK 70 marketed by HOECHST; IGRALITE GREEN GFNP marketed by CIBA), thickening agents ranging from 0.1% to 10% in weight (for example PRIMAL ASE 60 marketed by ROHM & HAAS; ALCOPRINT PTF marketed by LIBERTY CHEM.), dispersing additives ranging from 0.1% to 10% in weight (for example UMET 033 marketed by WARWICK; DISPERBYK 190 marketed by HULSS) and antifoaming additives ranging from 0.1% to 10% in weight (for example NOPCO 8034 marketed by NOPCO).

The solvents used, in proportion between 30% and 80% in weight, can for example include water, glycols, polyglycols, glycoethers and white spirits, including DOVANOL DPM marketed by UCE and EXXOL D40 marketed by ESSO.

Other additives may be envisaged for specific functions, for example biocides and pH correctors.

A typical formulation may comprise for example acrylic resin in emulsion (40% in weight) as a binder; titanium dioxide (20% in weight) as a pigment; talc (10% in weight) as a mineral charge; dispersing additives (3%), antifoaming agents (1%) and thickening agents (2%). Solvents may comprise water (9%), white spirit (10%) and propylene glycol (5%).

During the transfer step represented in FIG. 2, the cylinder 14 (together with cylinders 12 and 16 in FIG. 1) rotates in the direction indicated by arrow C to move the belt 100 in the direction N, while the transfer unit 70 moves in the direction indicated by arrow T.

Referring again to the view in FIG. 1, the cylinder 16 belonging to the transfer unit 70 is provided to cool the belt 100 in a controlled manner to take the belt to a temperature below the temperature at which the ink used starts to coagulate. This avoids belt 100, previously heated by the roller 14, to come into contact with the screen printing screen 50 at a temperature that would cause the ink on the screen to coagulate, thus causing unwanted clogging of the holes at the level of the impression 60.

The transfer medium or belt 100 is subjected to rapid variations in temperature for each printing cycle, with temperatures that can vary rapidly approximately from room temperature or even below this at the level of the cooling cylinder 16 to around 220–250° C. at the level of the heating cylinder 14 and must therefore have high thermal conductivity characteristics.

For example, it is possible to use a synthetic belt capable of withstanding sudden changes in temperature. A belt 100 which has given up to now the best results is made from a fabric in aramidic fibers coated with PTFE and having a thickness of around 200 micron.

Figure 3A:
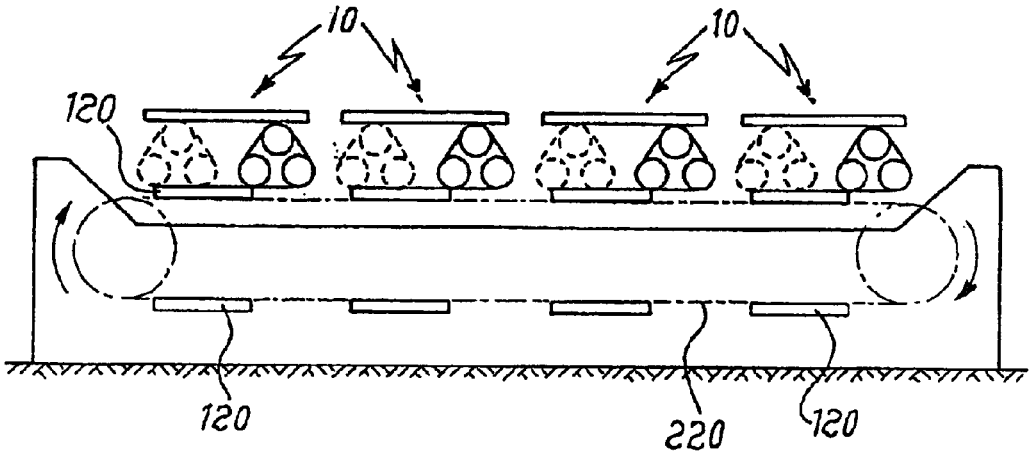
FIGS. 3A and 3B illustrate some examples of plants provided with several printing stations as those shown in FIG. 1.
Figure 3B:
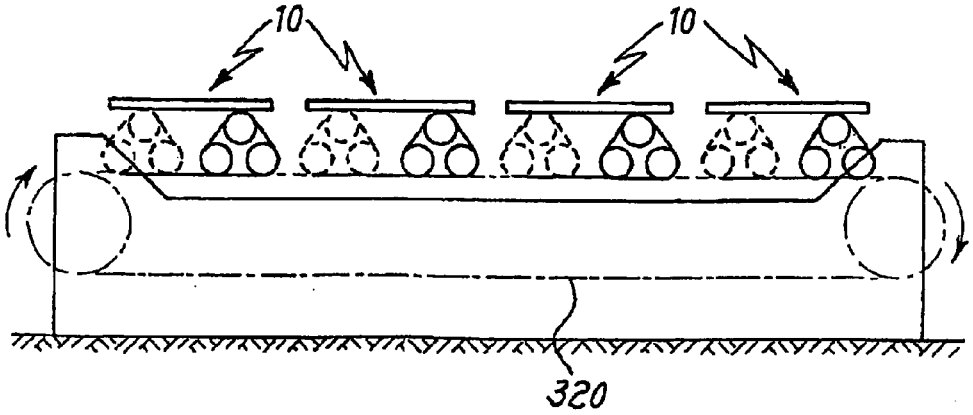

FIGS. 3A and 3B illustrate two examples of plants for printing on fabric with several colours in which there are four printing stations 10, one for each colour, each of which is implemented according to the embodiment shown in FIG. 1.

The plant in FIG. 3A comprises for example a conveyor belt 220 on which supporting tables 120 are arranged at regular intervals. This embodiment is particularly suitable for printing on pre-cut fabrics or finished garments, such as T-shirts or the like, which are each arranged on a supporting table 120 designed to pass sequentially under each printing station 10.

In the embodiment shown in FIG. 3B, the plant is equipped with a conveyor belt 320 without supporting tables. This embodiment is suitable both for printing on pre-cut fabrics and on an uncut continuous fabric.

Figure 4A:
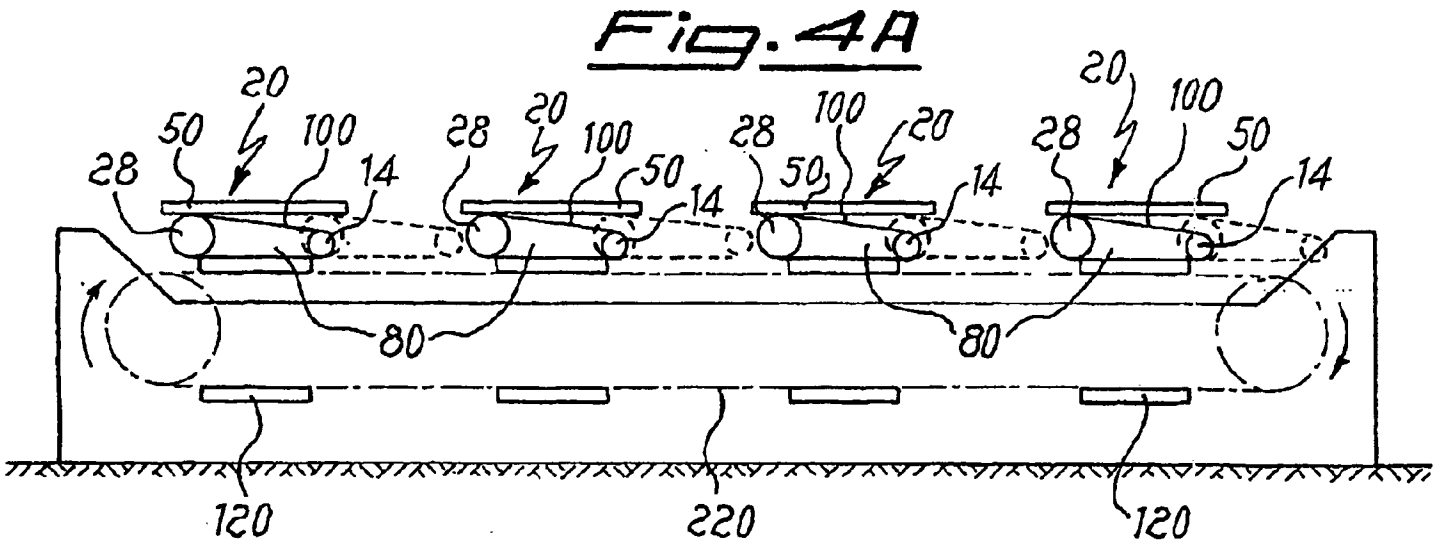
FIGS. 4A and 4B illustrate some examples of plants provided with several printing stations according to another possible embodiment of the present invention.
Figure 4B:
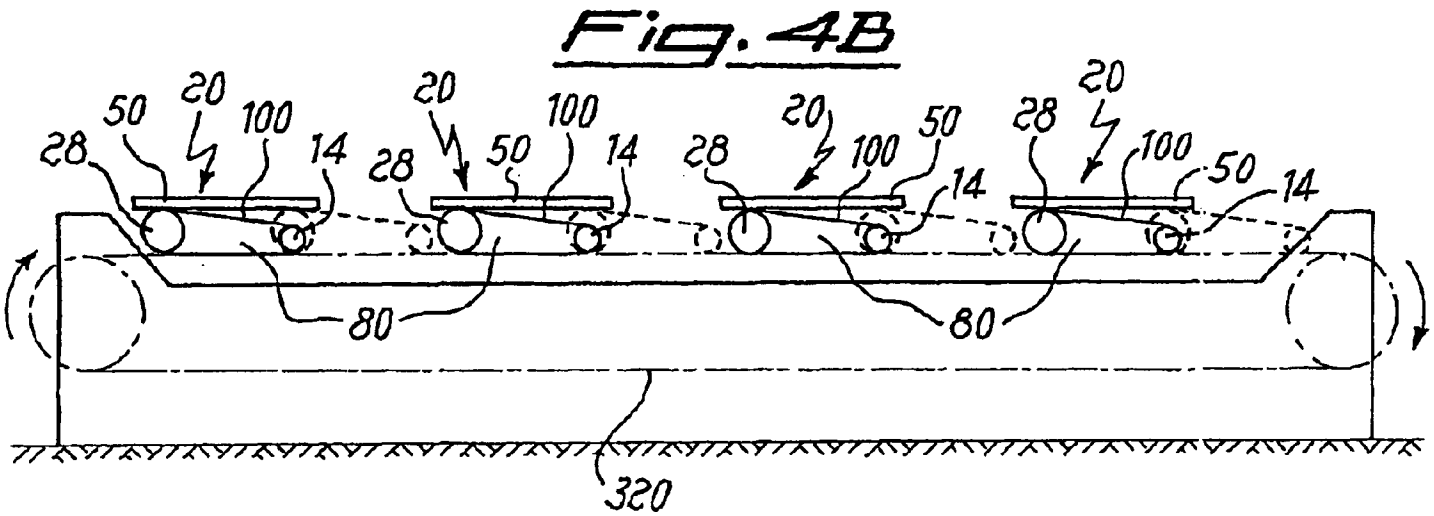

FIGS. 4A and 4B, in which the same reference numbers have been used for the components common to the methods of implementation already shown, illustrate two plants that use printing stations 20 in which the transfer units 80 are equipped with only two cylinders, namely a heating cylinder 14 with the same functions as the heating cylinder 14 already illustrated with reference to the embodiment in FIG. 1, and a cooling cylinder 28 which make to rotate a transfer medium or belt 100 identical to the one previously described. In this case, the cylinder 28 has a diameter larger than the cylinder 14 to allow cooling of the belt 100 and transfer of the ink from the screen 50 to the belt 100 at the level of this cylinder 28.

Naturally, the plants illustrated schematically in FIGS. 3A and 4A can be equipped with different systems to move the supporting tables 120, systems that are in any case well known and used in the technique.

FIGS. 5A–5E illustrate some steps of the process according to the invention with reference to movements and positions taken by a transfer unit 70 like the one illustrated in FIG. 1 in each printing station. The effective position of the transfer unit in each figure is the one in which the unit is represented schematically with cylinders and the belt, while the other positions are merely represented for reference with the outline of the belt 100 alone.

Figure 5A:
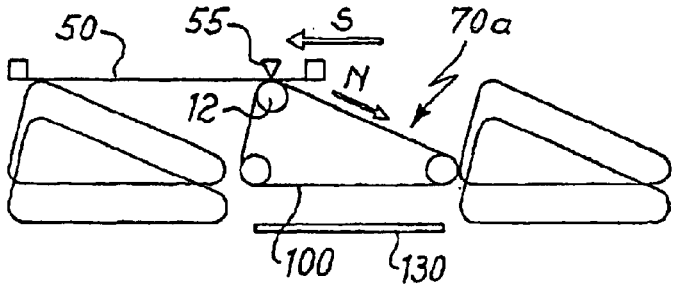
FIGS. 5A–5E illustrate some of the steps of the printing process with reference to a printing station like the one shown in FIG. 1.

FIG. 5A represents the initial step of transferring the ink to the belt 100 while the transfer unit is in the position indicated with reference 70*a*. A doctor blade 55 presses the screen printing screen 50 against the belt 100 at the level of the cylinder 12. From position 70*a*, the transfer unit moves together with doctor blade 55 in the direction indicated by arrow S while the belt 100 rotates in the direction indicated by arrow N to received the quantity of ink issued by the screen 50 during movement of the transfer unit.

Figure 5B:
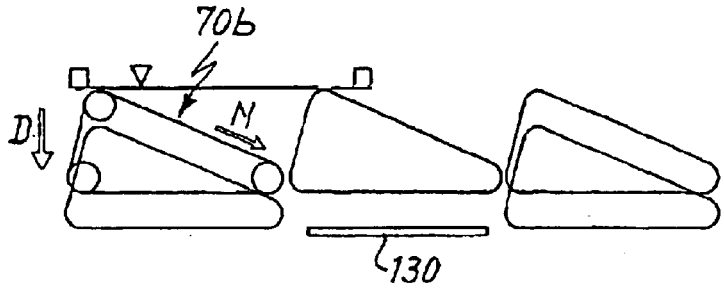
Figure 5C:
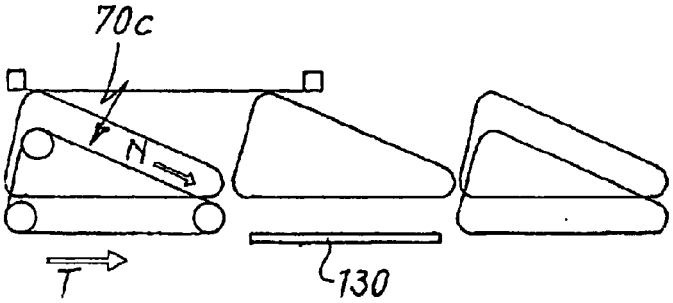
Figure 5D:
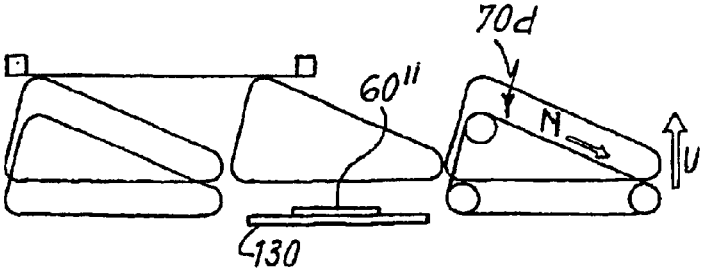
Figure 5E:
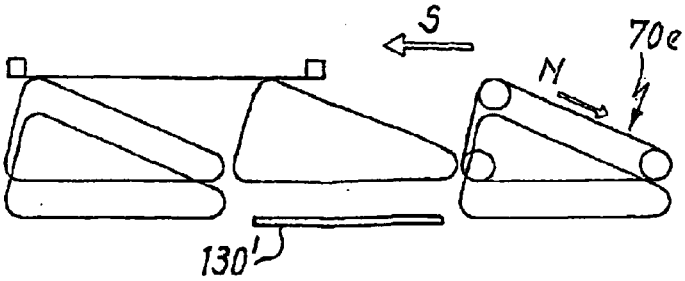

At the end of the step of application of the ink, the transfer unit is moved to position 70*b* indicated in FIG. 5B, from where it is subsequently moved downwards in the direction indicated by arrow D until it reaches position 70*c* indicated in FIG. 5C.

As from position 70*c*, it starts the step of transferring the ink onto the fabric 130 below. The transfer unit is moved in the direction indicated by arrow T towards the final position 70*d* indicated in FIG. 5D. At the end of the transfer step already illustrated previously with reference to FIGS. 1 and 2, on the substrate 130 there is an impression 60" with the characteristics already described. From the position 70*d* the transfer unit is moved upwards in the direction indicated by arrow U to reach the top position 70*e* (FIG. 5E) from which the transfer unit is moved again in the direction indicated by arrow S to again reach the starting position 70*a* represented in FIG. 5A, while the fabric 130 is moved to leave space for the next fabric 130' on which the impression is to be made.

During all these steps the belt 100 rotates continuously in the direction indicated by arrow N and the cylinders 14 and 16 are kept constantly at their respective operating temperatures.

FIGS. 6A–6E essentially represent the same steps of the process illustrated above with reference to a transfer unit 80 of the type with two cylinders, with the same conventions with regard to the previous representation and the same reference numbers of the parts in common with the previous description.

Figure 6A:
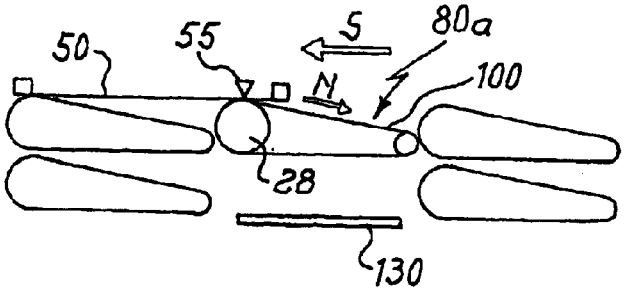
FIGS. 6A–6E illustrate some of the steps of the printing process with reference to a printing station like the one provided in the plants of FIGS. 4A and 4B.
Figure 6B:
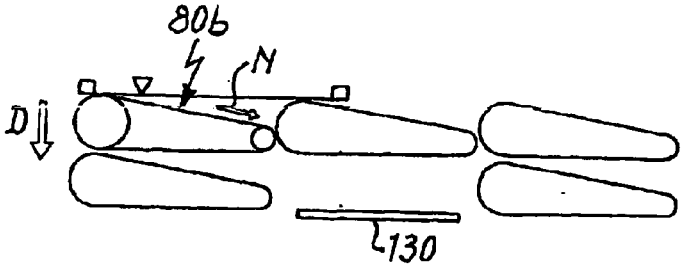

Therefore, in FIG. 6A the ink on the belt 100 starts to be applied while the transfer unit is in the position indicated with reference 80*a*. Unlike the previous method of implementing the process, the transfer is effected at the level of the cylinder 28, which also performs cooling of the belt 100. At the end of the step of applying the ink, the transfer unit is moved to position 80*b* indicated in FIG. 6B, and then downwards in the direction indicated by arrow D until it reaches the position 80*c* indicated in FIG. 6C.

Figure 6C:
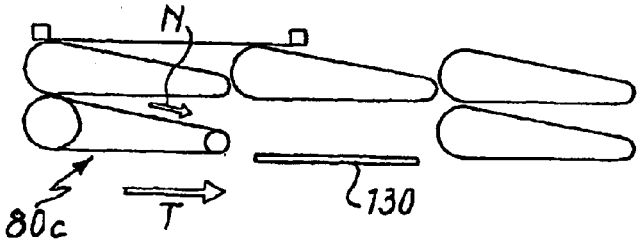
Figure 6D:
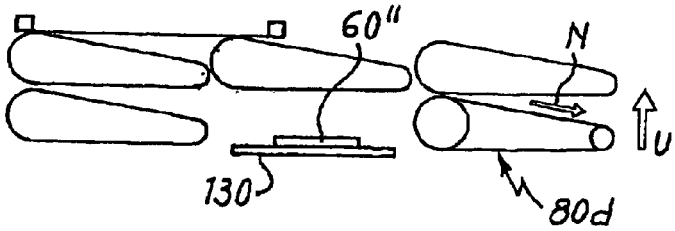
Figure 6E:
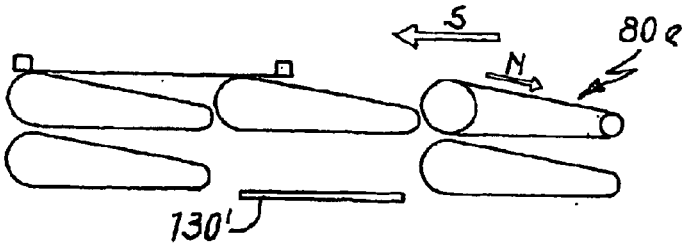

Here also transfer of the ink to the fabric below 130 is effected between positions 80*c* and 80*d* indicated respectively in FIGS. 6C and 6D. The impression 60" with the characteristics already described is thus transferred to the fabric 130. The transfer unit is then moved from position 80*d* upwards in the direction indicated by arrow U to reach the top position 80*e* (FIG. 6E) and then again to the initial position 80*a* (FIG. 6A) moving in the direction indicated by arrow S.

In this case also, the belt 100 is made to rotate continually in the direction indicated by arrow N and the two cylinders 14 and 28 are constantly kept at their respective operating temperatures.

Naturally, the movement of the substrate 130 illustrated in FIGS. 5A–5E and 6A–6E under the printing stations can be effected in any other known way in addition to those represented in the FIGS. 3A, 3B and 4A, 4B.

The embodiments described and illustrated herein represent only a few examples of implementation of the present invention and must not be intended as limiting. Various modifications can be made within the scope of the annexed claims.

For example, in addition to the screen printing techniques illustrated here to apply ink to the transfer medium 100, other known printing techniques or techniques for applying inks can be used. Moreover, the process and plant according to the present invention can also be used to apply compounds in general to fabric substrates, such as coating compounds or covering compounds which give the fabric special features, such as permeability, resistance or the like.

Moreover, the invention is not limited merely to the application of inks or coatings on fabrics in general, such as woven fabrics, non-woven fabrics and similar, but also on materials more generally made of natural and/or synthetic fibres, paper materials, synthetic films or permeable substrates that have a certain degree of permeability in relation to the compound applied.

What is claimed is:

1. A process for applying one or more compounds on a subtrate, comprising the steps of:

a) applying a preset amount of a mixture to a transfer medium, said mixture comprising said one or more compounds in the form of a solution, emulsion or suspension and being essentially liquid;

b) heating said transfer medium to a preset temperature to obtain at least a partial coagulation of a portion of said mixture which is in contact with said transfer medium, the other portion of said mixture remaining in its essentially liquid state; and c) placing said transfer medium in contact with said substrate by exerting a given pressure so that the coagulated portion of said mixture is placed on said substrate.

2. The process as claimed in claim 1, further comprising the step of cooling said transfer medium before applying again another preset amount of said mixture.

3. The process as claimed in claim 1, wherein said preset amount of mixture is applied according to a pre-established pattern.

4. The process as claimed in claim 1, wherein said mixture has an essentially liquid consistency at room temperature.

5. The process according to claim 1, wherein said mixture is a water-based product.

6. The process as claimed in claim 1, wherein said mixture comprises one or more resins selected from acrylic resins, vinyl resins, acrylic styrol resins, butadienic resins, vinylacrylate copolymer resins and polyurethane resins.

7. The process as claimed in claim 1, wherein said mixture is a water-based ink.

8. The process as claimed in claim 1, wherein said substrate is made of a material that is essentially permeable to said mixture in its liquid state and wherein, during step c), the remaining essentially liquid portion of said mixture penetrates said substrate.

9. The process as claimed in claim 1, wherein said substrate consists of a woven fabric or non-woven fabric.

10. The process as claimed in claim 1, wherein said substrate is made of a material comprising natural fibers and/or synthetic fibers.

11. The process as claimed in claim 1, wherein said substrate is made of a paper material.

12. The process as claimed in claim 1, wherein said transfer medium consists of a belt of synthetic material.

13. The process as claimed in claim 1, wherein said transfer medium is made of a fabric of aramidic fiber.

14. The process as claimed in claim 1, wherein said transfer medium is coated with PTFE.

15. The process as claimed in claim 1, wherein said step a) of applying a preset amount of mixture to said transfer medium is implemented by a screen printing technique.

16. A plant for applying one or more compounds to a substrate, comprising one or more stations, wherein each of said station includes:

a transfer medium;

means for applying to the transfer medium an essentially liquid mixture consisting of at least one of said compounds;

means for moving said transfer medium towards the substrate while maintaining said mixture in an essentially liquid state;

means for heating said transfer medium to a preset temperature to obtain at least a partial coagulation of a portion of said mixture which is in contact with said transfer medium and maintaining the other portion of said mixture in its essentially liquid state; and means for placing said transfer medium in contact with said substrate by exerting a given pressure so that the coagulated portion of said mixture is placed on said substrate.

17. The plant as claimed in claim 16, wherein the transfer medium in one or more of said stations consists of a closed belt which is made to rotate around at least two cylinders.

18. The plant as claimed in claim 17, which comprises at least a first cylinder to heat in a controlled manner said transfer medium and to exert in a controlled manner the contact pressure between said transfer medium and said substrate, and at least a second cylinder to cool in a controlled manner said transfer medium.

19. The plant as claimed in claim 18, wherein said mixture is applied to said transfer medium with said second cylinder.

20. The plant as claimed in claim 16, wherein the transfer medium in one or more of said stations consists of a closed belt which is made to rotate around at least three cylinders.

21. The plant as claimed in claim 20, which comprises at least a first cylinder to heat in a controlled manner said transfer medium and to exert in a controlled manner the contact pressure between said transfer medium and said substrate; at least a second cylinder to cool in a controlled manner said transfer medium; and at least a third cylinder correspondence of which said mixture is applied to said transfer medium.

22. The plant as claimed in claim 16, wherein said transfer medium consists of a belt of synthetic material.

23. The plant as claimed in claim 16, wherein said transfer medium consists of a fabric of aramidic fiber.

24. The plant as claimed in claim 16, wherein said transfer medium is coated with PTFE.

25. The plant as claimed in claim 16, wherein said means to apply said mixture to said transfer medium in one or more of said stations consist of a screen printing device.

* * * * *